US006469237B1

(12) United States Patent
Arimori

(10) Patent No.: US 6,469,237 B1
(45) Date of Patent: Oct. 22, 2002

(54) APPARATUS FOR OPENING AND CLOSING TOP BOARD OF GRAND PIANO

(75) Inventor: Manabu Arimori, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 09/693,954

(22) Filed: Oct. 23, 2000

(30) Foreign Application Priority Data

Oct. 28, 1999 (JP) ..... 11-306664
Jan. 17, 2000 (JP) ..... 2000-007931

(51) Int. Cl.[7] ..... G10C 1/00
(52) U.S. Cl. ..... 84/174; 84/177; 84/178; 84/180; 84/184
(58) Field of Search ..... 84/174–180, 182, 84/184

(56) References Cited

U.S. PATENT DOCUMENTS 962,748 A * 6/1910 Cook ..... 84/174
1,101,367 A * 6/1914 Wilberg ..... 84/180
1,498,955 A * 6/1924 Dinsmore ..... 84/180
1,785,486 A * 12/1930 Kursheedt ..... 84/177
3,921,958 A * 11/1975 Brockelsby et al. ..... 254/420
4,238,113 A * 12/1980 Adams ..... 254/425
4,789,133 A * 12/1988 Liaw ..... 254/103
5,804,745 A * 9/1998 Higasa ..... 84/182
5,920,019 A * 7/1999 Inoue ..... 84/179

FOREIGN PATENT DOCUMENTS

JP 9-146534 9/1997
JP 9-230851 9/1997
JP 11-231861 8/1999
JP 02000007291 * 1/2000

* cited by examiner

*Primary Examiner*—Shih-Yung Hsieh
(74) *Attorney, Agent, or Firm*—Arent Fox Kintner Plotkin & Kahn

(57) ABSTRACT

In an apparatus for opening an closing a top board of a grand piano, the top board is hingedly supported along one side thereof on an outer rim of the grand piano. The apparatus has a gear-type of jack made up of a jack main body fixed to a wooden fame of the grand piano, and a rod which is movable in a longitudinal direction through the jack main body and which supports the top board in a manner to open and close said top board.

7 Claims, 6 Drawing Sheets

APPARATUS FOR OPENING AND CLOSING TOP BOARD OF GRAND PIANO

BACKGROUND OF THE INVENTION

1. Field of the Invention

The present invention relates to an apparatus for opening and closing a top board of a grand piano.

2. Description of Related Art

As shown in FIG. 9, there has been conventionally known an apparatus for opening and closing a top board of a grand piano. In this apparatus, a top board "a" of the grand piano is hingedly or pivotally supported along one side of the top board which is on an outer rim b on the side of low-pitched sound keys (i.e., on the left side as seen from a piano player) by means of top hinges c. When the top board is opened, that side of the top board "a" which lies on the side of the high-pitched sound keys (i.e., on the right side as seen from the piano player) is lifted by hands and is kept in the lifted position by supporting it with a top board prop d. On an inner surface or a lower surface of the top board "a", there are provided top board stick cups e so that the front end of the top board prop d can be engaged into one of the top board stick cups e to thereby safely keep the top board "a" in an open state.

The top board "a" of the grand piano ordinarily weighs as much as 40 to 50 kgs. Therefore, a piano player who is not strong enough to manually lift it up cannot safely open it. Should his or her fingers or hands slip off the top board "a" by mistake, the open end of the top board "a" suddenly and unexpectedly drops onto the outer rim b, which is to be avoided from the viewpoint of safety. In order to avoid such a sudden and unexpected dropping of the top board "a", there has been disclosed the following apparatus in Published Unexamined Japanese Patent Application No. 146534/1997. Namely, a rotary type of damper is attached to an outer rim. A force of rotation is given by a coil spring to an axis of rotation of the damper. An arm which is connected to a rotary shaft of the damper supports the top board. By means of the rotary force of the coil spring, an auxiliary force to assist the opening motion is given at the time of opening the top board. At the same time, the dropping energy of the top board is absorbed by the rotary force and the dampening function of the damper. In Published Unexamined Japanese Patent Application No. 231861/1999, there is disclosed the following apparatus. Namely, a cylinder filled with a pressurized gas gives an auxiliary force at the time of opening the top board. When the top board is closed, a damping device absorbs or buffers the shocks at the time of closing the top board.

In the above-described conventional apparatus in which the damper is used, there is an advantage in that a special control apparatus is not required for operating the damper. However, in order to firmly fix the damper to the grand piano, the position of fixing the damper is naturally limited to the outer rim. If that arm of the damper which extends therefrom is short in length, there will be operated on the top hinges a large moment of rotation of the top board which is rotated or swung about the top hinges. As a result, the outer rim is likely to be damaged. If the length of the arm is long, on the other hand, the force of rotation to be operated on the rotary shaft of the damper also becomes large. Therefore, the damper itself and the coil spring must be made large in size, resulting in a poor aesthetic appearance of the grand piano. In addition, there is a disadvantage in that the damper becomes complicated in construction and expensive in cost.

On the other hand, in the above-described conventional apparatus in which is used the cylinder filled with a pressurized gas, the top board is arranged to be closed due to its own weight. The braking or restriction of the falling top board is attained by providing a damping device, and no particular measure is taken to positively prevent the top board from dropping.

Furthermore, in any of the above-described conventional apparatuses, the top board must be opened and closed by manually or personally holding the top board with hands of the piano player. This operation is troublesome.

In view of the above points, the present invention has an object of providing that apparatus for opening and closing a top board of a grand piano which can be easily mounted on the grand piano in a small space for installation and which is inexpensive in manufacturing and does not impair the aesthetic appearance of the grand piano.

SUMMARY OF THE INVENTION

In order to attain the above and other objects, the present invention is an apparatus for opening an closing a top board of a grand piano. The top board is hingedly supported along one side thereof on an outer rim of the grand piano. The apparatus comprises a gear-type of jack made up of: a jack main body fixed to a constituting member of the grand piano; and a rod which is movable in a longitudinal direction through the jack main body and which supports the top board in a manner to open and close the top board.

Preferably, an upper end of the rod is in slidable contact with the top board so as to be slidable along an inner surface of the top board.

The apparatus may further comprises a link disposed between the upper end of the rod and the top board, and the link is pivotally supported at the upper end of the rod and at the top board. The link may comprise a first link element one end of which is pivotally coupled to an inner surface of the top board, and a second link element one end of which is pivotally coupled to the constituting member and an opposite end of which is pivotally coupled to an opposite end of the first link element. The upper end of the rod is coupled to the second link in a manner to swing the second link.

A driving shaft for driving the gear-type of jack may be coupled to a handle which is disposed under a key bed or to an electric motor which is coupled to a driving shaft for driving the gear-type of jack in one and opposite directions of rotation.

The rod may have a threaded portion, and a worm wheel in gearing mesh with the threaded portion is meshed with a worm formed on the driving shaft.

According to the above-described arrangement of the present invention, by hingedly supporting the top board by means of the rod of the gear-type of jack, the top board can be opened and closed by a small stroke of the rod. In addition, by coupling the driving shaft of the gear-type of jack to the handle or to the electric motor, and rotating the driving shaft in the normal and the opposite directions of rotation, the opening and closing of the top board becomes easy. Further, since the rod has a threaded portion and the worm wheel in gearing mesh with the threaded portion is meshed with a worm formed on the driving shaft, the position of the top board can be arbitrarily selected and immovably fixed thereto.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Preferred embodiments of the present invention will now be explained with reference to the accompanying drawings.

Figure 1:
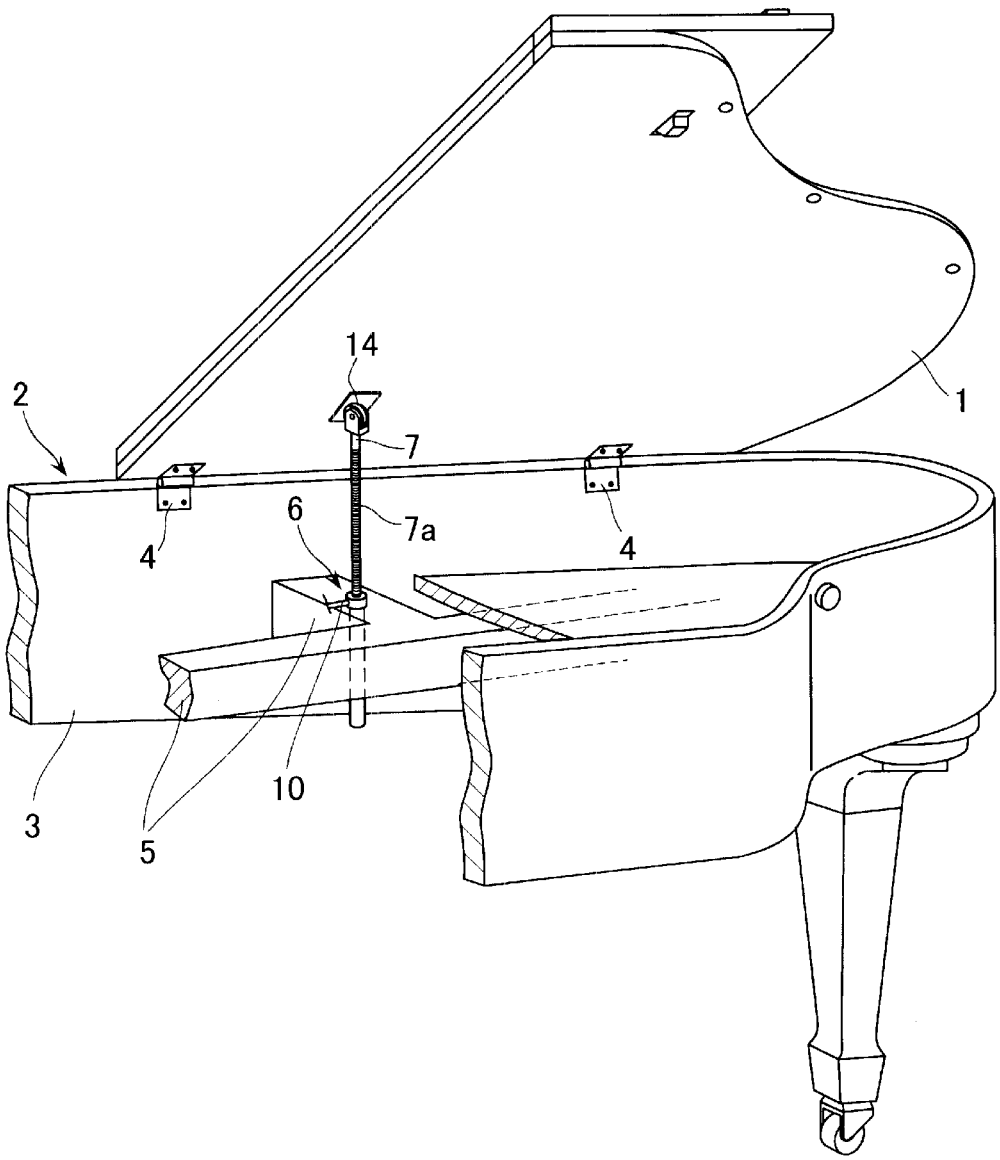
FIG. 1 is a perspective view, partly shown in section, of a grand piano in which one example of the apparatus for opening and closing the top board of the present invention is employed.
Figure 2:
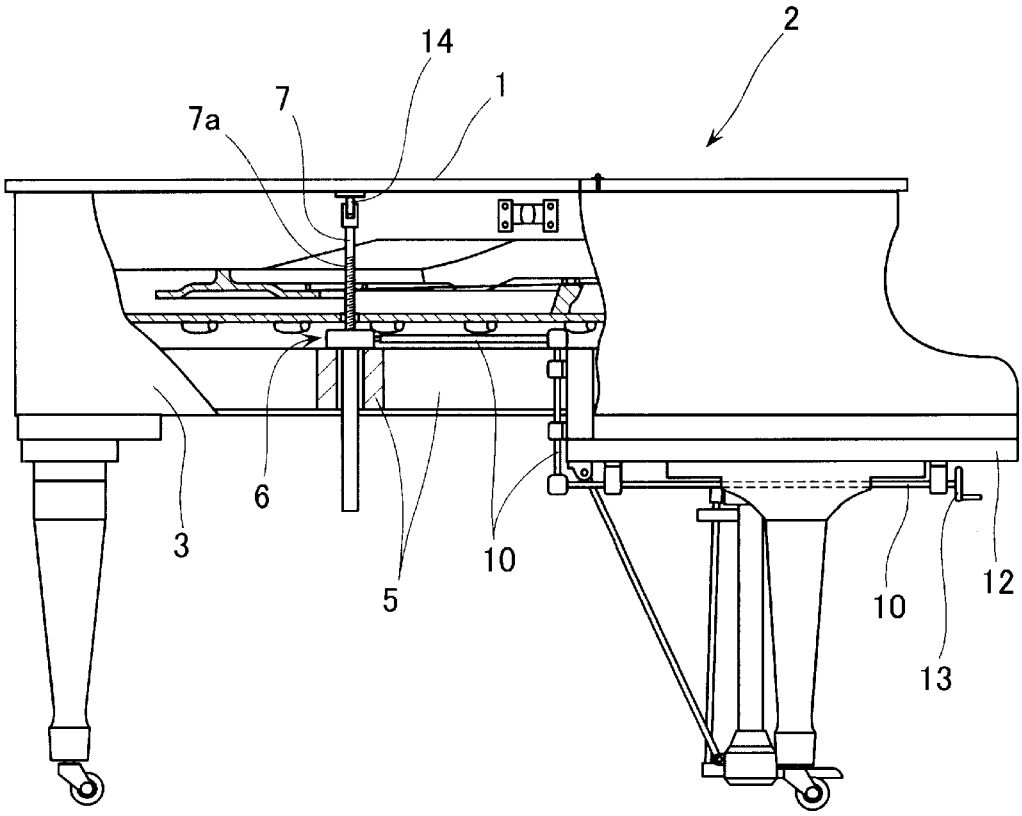
FIG. 2 is a side view, partly shown in section, of the apparatus in FIG. 1.

In FIGS. 1 and 2, reference numeral 1 denotes a top board of a grand piano 2. The top board 1 is supported on an outer rim 3 of the grand piano 2 by means of top hinges 4, 4 which support the top board 1 in a hinged manner so that the top board 1 can be opened and closed by swinging or rotation about the top hinges 4, 4. Reference numeral 5 denotes a wooden frame of the grand piano 2, the wooden frame 5 being one of constituting elements of the grand piano.

The top board 1 is supported by means of a gear-type of jack 6 (i.e., a jack operated by the operation of gears) which is supported on a constituting member of the grand piano such as the wooden frame 5 or the like which is strong enough to support the load of the top board inclusive of the gear-type of jack 6 in operation. A top or front end of a rod 7 which longitudinally extends (vertically extends in this example) through the gear-type of jack 6 supports the lower end of the top board 1. It is thus so arranged that, by the vertical movement of the rod 7, the top board 1 can be safely opened and closed by the swinging operation of the top board 1 about the top hinges 4, 4.

Figure 3:
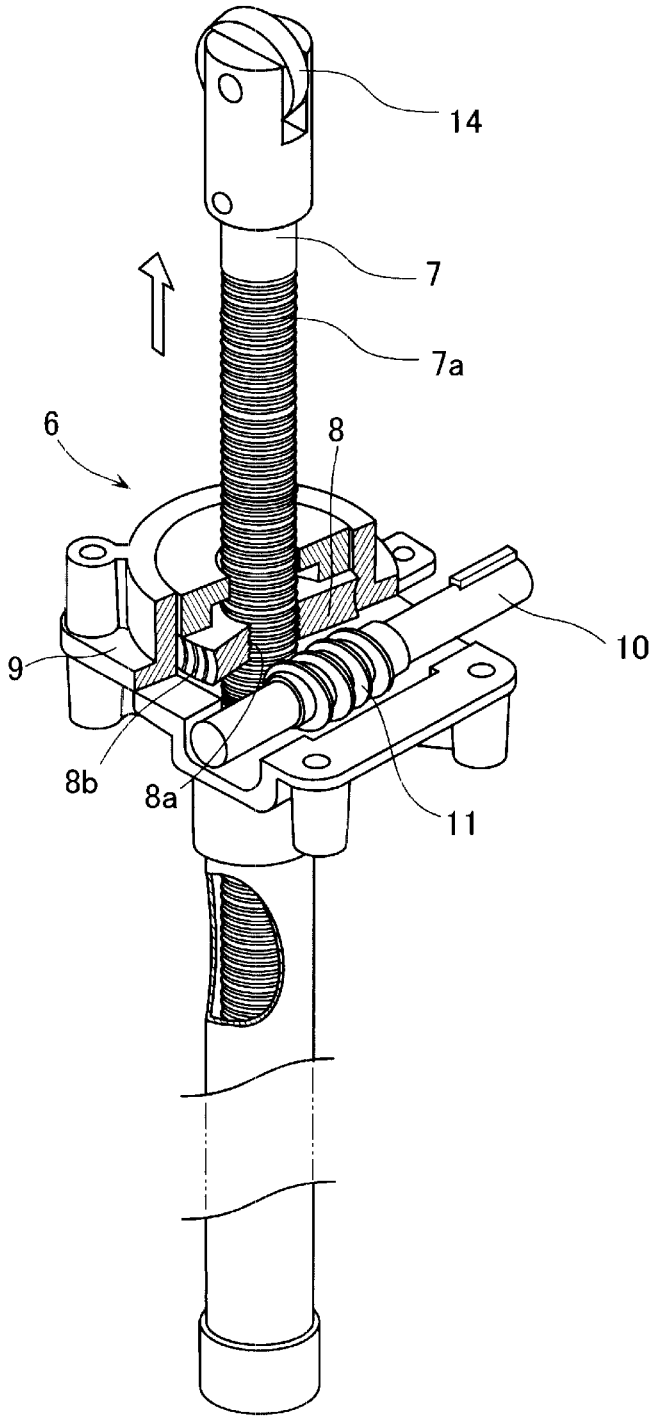
FIG. 3 is an enlarged perspective view of a gear-type of jack shown in FIG. 2.

In more detail, the gear-type of jack 6 has the following construction. Namely, as shown in FIG. 3, it comprises a jack main body 9 which is provided with a fixing portion for fixing it to the constituting member, i.e., the wooden frame in this example. A worm wheel 8 which has an inner threaded hole 8*a* is contained inside the jack main body 9. The rod 7 has a threaded portion 7*a* on its periphery (or outer circumference). This threaded portion 7*a* is brought into gearing mesh with the inner threaded hole 8*a*. The worm wheel 8, which is rotatably supported inside the jack main body 9, has formed on its outer circumference a worm gear teeth 8*b*. This worm gear teeth 8 are brought into gearing mesh with a worm 11 which is formed in a driving shaft 10.

The driving shaft 10 is extended, as shown in FIG. 2, downward along the wooden frame 5, and a handle 13 is attached to that end of the driving shaft which is in easy access by a piano player. At the top end of the rod 7, there is provided a roller 14 which comes into sliding contact with the inner surface of the top board 1. The rod 7 is prevented from rotating relative to the jack main body 9 by means of a key (not illustrated).

Figure 4:
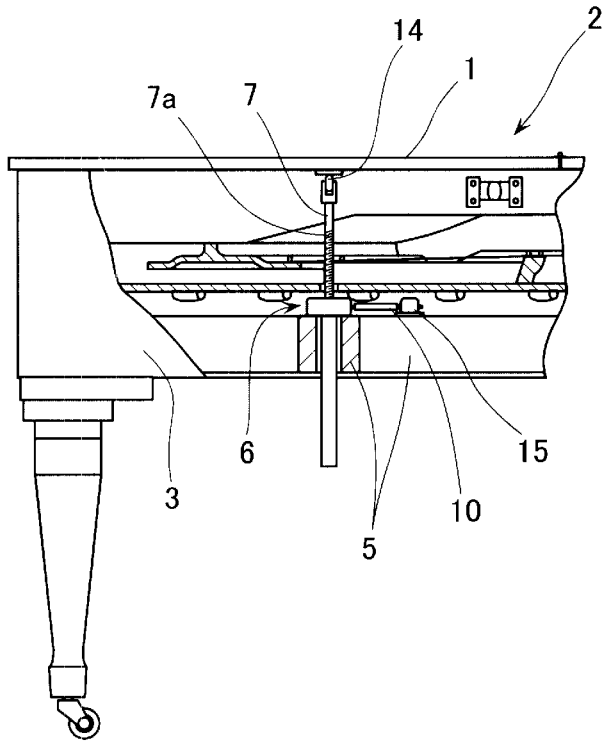
FIG. 4 is a sectional view of another example of the present invention.

In operation, when the driving shaft 10 is rotated by the rotation of the handle 13, the worm wheel 8 is rotated through the worm 11. As a result, the rod 7 moves up and down to thereby open and close the top board 1. Due to an appropriately selected reduction gear ratio of the gear-type of jack 6, the top board 1 can be opened and closed at a relatively small force of rotating the handle 13. Further, the top board 1 can be held at an arbitrarily opened position. This arrangement does not require a top board prop and, as a result, it is not required for the piano player to directly touch the top board 1. It follows that, even if the open end of the top board 1 suddenly drops, by accident, toward the closing direction, the player is free from the possibility of pinching his or her fingers between the top board 1 and the outer rim 3 of the grand piano 2. In addition, since the gear-type of jack 6 can be arranged relatively small in size, the space for mounting it on the grand piano can be saved and the aesthetic appearance of the grand piano is not sacrificed by mounting the gear-type of jack 6. Further, since the handle 13 is disposed in a position which is in easy access by the piano player, he or she can advantageously open or close the top board 1 in a posture ready for playing (i.e., while sitting on a chair). In order to further improve the ease with which the top board 1 can be opened and closed, the drive shaft 10 may be driven by an electric motor 15 as shown in FIG. 4.

Figure 5:
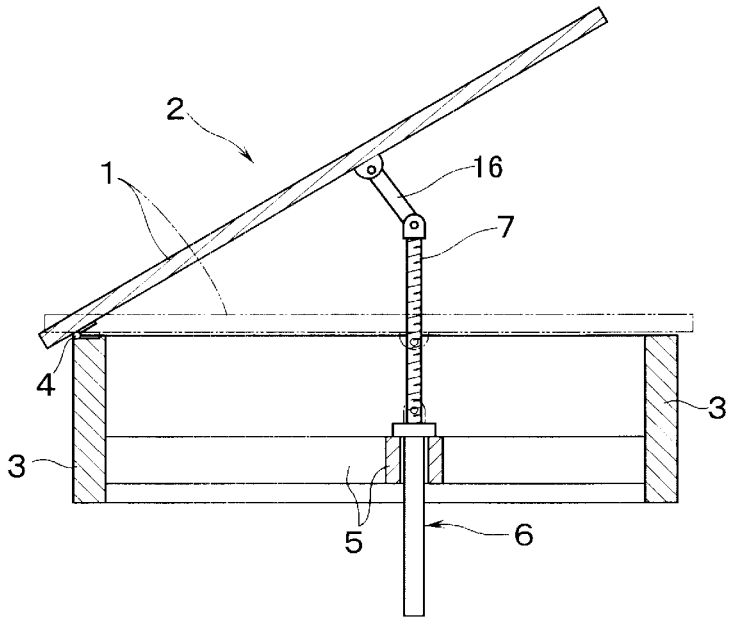
FIG. 5 is a sectional view showing the state in which the gear-type of jack is coupled to the top board through a link.

In case a larger stroke of the rod 7 can be secured, the following arrangement may be employed. Namely, as shown in FIG. 5, the gear-type of jack 6 is disposed in a position further away from the top hinge 4. A link 16 is interposed between the top end of the rod 7 and the inner surface of the top board 1 to thereby support the top board 1 through the link 16. By the upward and downward movement of the link 16, the top board 1 is opened and closed.

Figure 6:
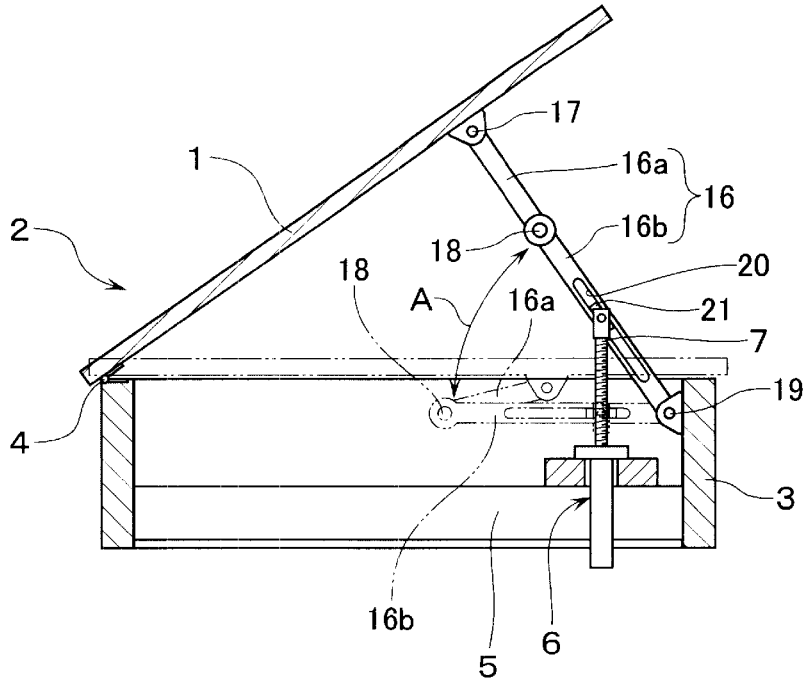
FIG. 6 is a sectional side view of a modified example in which the link is constituted by two links.
Figure 7:
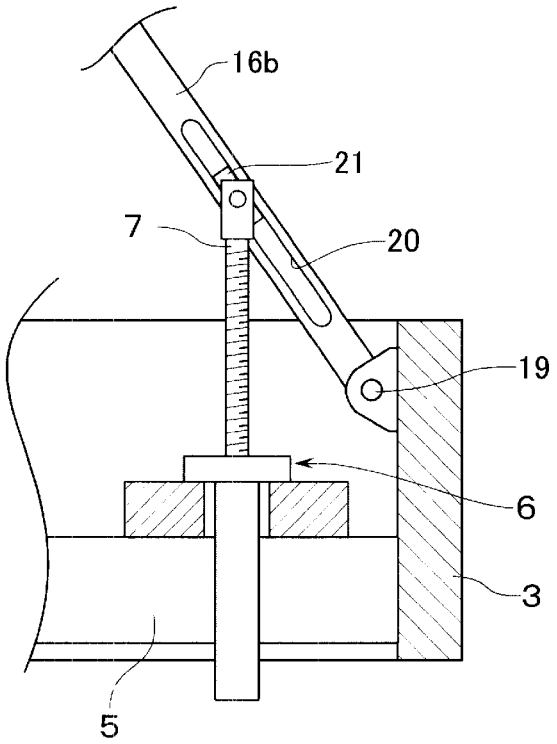
FIG. 7 is a side view showing an example of coupling portion of the gear-type of jack and the link.
Figure 8:
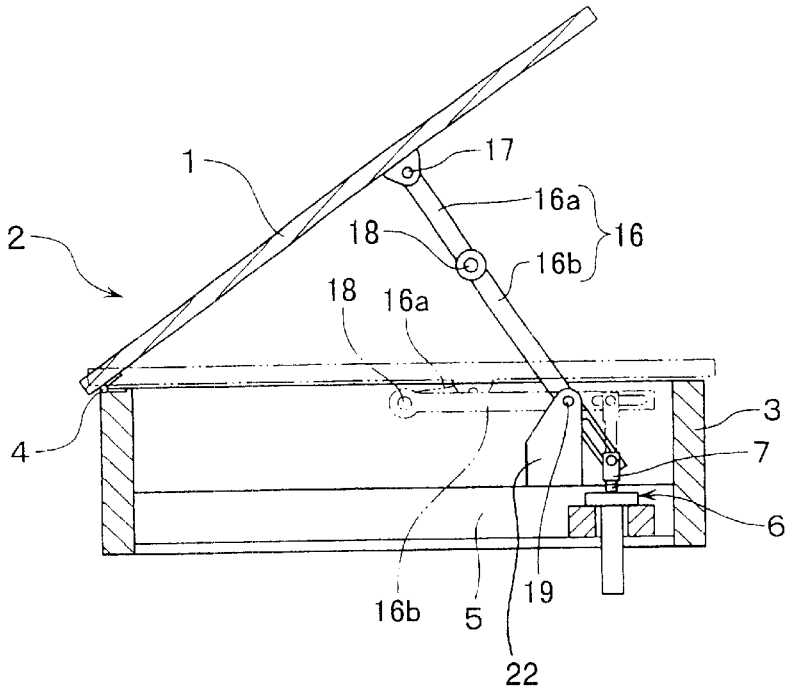
FIG. 8 is a side view of a modified example of the link.
Figure 9:
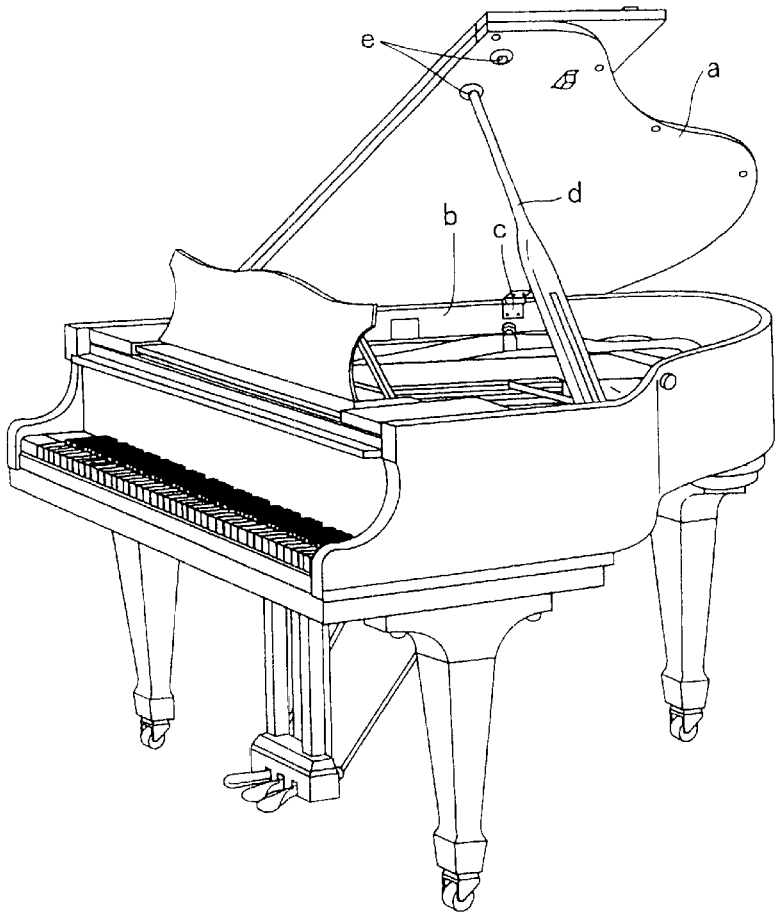
FIG.9 PRIOR ART
FIG. 9 is a perspective view of a conventional grand piano.

In still another modified example, the following arrangement may be employed. Namely, as shown in FIG. 6, the link 16 is made up of a first link element 16*a* and a second link element 16*b*. One end of the first link element 16*a* is rotatably or swingably connected to the inner surface of the top board 1 by means of a supporting shaft 17. One end of the second link element 16*b*, on the other hand, is rotatably or swingably connected, through a supporting shaft 19, to a constituting member of the grand piano 2 such as the wooden frame 5 or the outer rim 3 and the other end of the second link element 16*b* is rotatably or swingably connected to the other end of the first link element 16*a* through a connecting portion 18. The second link element 16*b* and the top end of the rod 7 are connected to each other in a manner to swing the second link element 16*b*. The connection between the second link 16*b* and the top end of the rod 7 may be arranged as follows. Namely, as shown in FIG. 7, the top end of the rod 7 is connected to a sliding member 21 which is slidably disposed in a slot 20 which is formed along a longitudinal direction of the second link element 16*b*. Alternatively, as shown in FIG. 8, a bracket or an arm member 22 is provided to rotatably support the second link element 16*b* at an intermediate portion thereof. Top end of the rod 7 is connected to the lower end of the second link element 16*b* through a slot formed to extend along the second link element 16*b* so as to swing the second link element 16*b* about a supporting shaft 19 as a center of rotation.

The supporting shaft 19 of the second link element 16*b* is positioned below the top hinge 4 not to hinder the opening and closing operation of the top board 1. In the example shown in FIG. 6, the second link element 16*b* swings in an arc illustrated by an alphabet "A" by the operation of the jack 6. The top board 1 can thus be opened and closed at an arbitrary angle between a fully opened position and a fully closed position. If the top end of the rod 7 is operably attached to that position of the second link element 16*b* which is near the supporting shaft 19, the second link element 16*b* can be given a predetermined swinging by a small stroke of the rod 7. In addition, since the rod 7 is in a screwed engagement at its screwed portion 7*a* with the threaded hole 8*a* of the worm wheel 8, the rod 7 will never freely move up and down during the stroke movement of the rod 7. When the rod 7 is at a standstill, an immovable state can be secured and, as a consequence, the second link element 16*b* can also be immovably stopped in position. It follows that the first link element 16*a* which is attached to the top board 1 through the supporting shaft 17 as well as the top board 1 itself also become an immovable state.

The operation of this embodiment can be made by rotating the driving shaft 10 of the gear-type of jack 6 by means of the handle 13 or the electric motor 15. The top board 1 can thus be remotely operated without physically touching the top board 1 itself on the part of the piano player. If the first link element 16*a* is disposed in a position remote from the top hinge 4 to thereby open and close the top board 1, the force of moment to be operated on the top hinges 4, 4 can be reduced. Therefore, there is no need of making the hinges 4, 4 and the outer rim 3 of the grand piano 2 in a particularly stout construction. The apparatus for opening and closing the top board can thus be made inexpensive.

The above-described link 16 and link elements 16*a*, 16*b* can be designed into suitable lengths depending on the position of attaching, the opening degree of the top board 1, or the like. Further, their shapes and colors may be appropriately selected to suit the design of respective grand pianos from the aesthetical point of view.

As can be seen from the above description, according to the present invention, the top board of the grand piano is supported by the rod which is movable in a longitudinal direction through the jack main body of the gear-type of jack to thereby open and close the top board. The top board can thus be opened and closed in a stepless manner with a relatively small force. In addition, since the top board can be prevented from suddenly falling or closing on the player's fingers or the like as long as the gear-type of jack functions normally, the safety for the player is improved. Further, the top board prop can advantageously be omitted. Still furthermore, since the gear-type of jack constituting the main portion of the apparatus of the present invention can be made small in size, the apparatus can be installed into the grand piano without sacrificing the aesthetic view of the grand piano. In addition, by connecting the top board to the gear-type of jack through the link and/or link elements, the top board can be opened and closed at a small stroke of the gear-type of jack. The apparatus can therefore be installed in the grand piano without increasing the load on the top hinges or to the outer rim. By connecting the driving shaft of the gear-type of jack to the handle below the key bed, or to the electric motor, the opening and closing operation can be made at a position away from the top board. This improves the ease with which the top board can be opened and closed and increases the safety in the operation of opening and closing the top board.

It is readily apparent that the above-described apparatus for opening and closing a top board of a grand piano meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An apparatus for opening and closing a top board of a grand piano, said top board being hingedly supported along one side thereof on an outer rim of the grand piano, said apparatus comprising a gear-type of jack made up of: a jack main body fixed to a constituting member of the grand piano; a rod which is movable in a longitudinal direction through said jack main body and which supports said top board in a manner to open and close said top board; and a link disposed between said upper end of said rod and said top board;

wherein said rod has a threaded portion and wherein a worm wheel in gearing mesh with said threaded portion is meshed with a worm on a driving shaft; and wherein said link is pivotally supported at said upper end of said rod and at said top board.

2. An apparatus for opening and closing a top board of a grand piano, said top board being hingedly supported along one side thereof on an outer rim of the grand piano, said apparatus comprising a gear-type of jack made up of: a jack main body fixed to a constituting member of the grand piano; a rod which is movable in a longitudinal direction through said jack main body and which supports said top board in a manner to open and close said top board; and a link disposed between said upper end of said rod and said top board;

wherein said rod has a threaded portion and wherein a worm wheel in gearing mesh with said threaded portion is meshed with a worm on a driving shaft; and wherein said link comprises a first link element one end of which is pivotally coupled to an inner surface of said top board, and a second link element one end of which is pivotally coupled to said constituting member and an opposite end of which is pivotally coupled to an opposite end of said fist link element, and wherein said upper end of said rod is coupled to said second link in a manner to swing said second link.

3. An apparatus for opening and closing a top board of a grand piano, said top board being hingedly supported along one side thereof on an outer rim of the grand piano, said apparatus comprising a gear-type of jack made up of: a jack main body fixed to a constituting member of the grand piano; and a rod which is movable in a longitudinal direction through said jack main body and which supports said top board in a manner to open and close said top board;

wherein said rod has a threaded portion and wherein a worm wheel in gearing mesh with said threaded portion is meshed with a worm on a driving shaft.

4. The apparatus according to claim 3, wherein an upper end of said rod is in slidable contact with said top board so as to be slidable along an inner surface of said top board, whereby slidable contact is accomplished by a roller.

5. The apparatus according to claim 3, further comprising a link disposed between said upper end of said rod and said top board.

6. The apparatus according to any one of claims 2–5 and 3, wherein a driving shaft for driving said gear-type of jack is coupled to a handle which is disposed under a key bed.

7. The apparatus according to any one of claims 2–5 and 3, further comprising an electric motor coupled to a driving shaft for driving said gear-type of jack in one and opposite directions of rotation.

* * * * *